US006244527B1

(12) United States Patent
Ferrazza et al.

(10) Patent No.: US 6,244,527 B1
(45) Date of Patent: Jun. 12, 2001

(54) QUICK DISCONNECT NOZZLE ASSEMBLY

(75) Inventors: Gerald P. Ferrazza, Schaumburg; Evelyn Celio, Chicago; Dale Johnson, Naperville, all of IL (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 09/492,024

(22) Filed: Jan. 26, 2000

(51) Int. Cl.[7] ..... B05B 1/00
(52) U.S. Cl. ..... 239/600
(58) Field of Search ..... 239/600

(56) References Cited

U.S. PATENT DOCUMENTS

| | | | |
|---|---|---|---|
| 4,185,781 | 1/1980 | O'Brien | 239/600 |
| 4,438,884 | 3/1984 | O'Brien et al. | 239/600 |
| 4,527,745 | 7/1985 | Butterfield et al. | 239/600 |
| 5,190,224 | 3/1993 | Hamilton | 239/600 |
| 5,421,522 | 6/1995 | Bowen | 239/600 |
| 5,727,739 | 3/1998 | Hamilton | 239/600 |

FOREIGN PATENT DOCUMENTS

| | | | |
|---|---|---|---|
| 450 946 * | 10/1996 | (EP) | 239/600 |

* cited by examiner

*Primary Examiner*—Lesley D. Morris
(74) *Attorney, Agent, or Firm*—Leydig, Voit & Mayer, Ltd.

(57) ABSTRACT

A quick disconnect spray nozzle assembly having a nozzle body for connection to a fluid supply source and a removable and replaceable spray tip. The spray tip carries an externally mounted, elongated, tubular seal and biasing member which has an asymmetrical design, including an enlarged cylindrical downstream end and a rounded upstream end, configured for effecting radial and axial sealing forces upon engagement with seal a seating cavity in the nozzle body. The spray tip further includes radial camming and locking lugs having planar camming, detent, and locking surfaces which cooperate with the nozzle body for drawing the spray tip into mounted engagement, with the elongated sealing member interposed therebetween, as an incident to quick turn rotation of the spray tip and without the necessity for manually forcing the spray tip against the seal and biasing member.

47 Claims, 4 Drawing Sheets

QUICK DISCONNECT NOZZLE ASSEMBLY

FIELD OF THE INVENTION

The present invention relates generally to fluid spray nozzle assemblies, and more particularly, to spray nozzle assemblies comprising a spray tip capable of being quickly connected and disassembled from a nozzle body.

BACKGROUND OF THE INVENTION

Spray nozzles are used in many industrial, agricultural, and commercial applications in which it frequently is necessary to remove the spray tip for various reasons, such as inspection and cleaning, replacement of a worn spray tip or seals, or substitution of the spray tip in order to change the spray pattern. It is desirable, therefore, that such spray nozzle assemblies permit quick and easy spray tip removal, while insuring precise tip orientation and reliable sealing characteristics upon replacement.

Most standard spray nozzles use a threaded pipe connection for attachment to the fluid source. There are significant limitations to the utility of such spray nozzles in many applications. If it is necessary to orient the discharging spray pattern in a specific direction, the spray nozzle must be manually realigned each time the nozzle is removed and replaced. Tools also usually must be used when installing or removing threaded spray nozzles, which is time consuming and expensive.

Various quick disconnect spray nozzle assemblies have been proposed in order to enable the spray tip to be installed and removed by hand. Some quick disconnect nozzle assemblies have utilized an O-ring sealing member and a pressure applying spring which biases and maintains the spray tip in its operative and sealed position. Some quick disconnect spray nozzle assemblies have used an elongated, tubular-shaped combination seal and pressure exerting member, which eliminates the need for a separate biasing spring. Such quick disconnect spray nozzles can require the user to exert a significant manual force on the spray tip in order to overcome the force of the spring or elongated sealing member during assembly of the spray tip in the nozzle body. In some cases, the spray nozzle tip can be inserted in the nozzle body and twisted beyond its mounted position, necessitating that the spray tip be twisted repeatedly in opposite directions to insure proper alignment. Moreover, since the elongated combination sealing and biasing member used in quick disconnect nozzles of the foregoing type are mounted internally within the nozzle body, it also is difficult to observe whether the seal is in properly installed condition.

Furthermore, since it is common practice to flush and clean spray nozzles with the spray tips removed, this can cause the sealing member disposed within the nozzle body to become dislodged and forcefully ejected from the body by pressurized cleaning liquid directly through the nozzle, necessitating retrieval and replacement. On the other hand, proposals for mounting large tubular sealing and biasing members on the tip have not been considered desirable because it would significantly increase the size and mass of each spray tip.

Other quick disconnect spray nozzle assemblies utilize camming surfaces adapted for moving the spray tip into and out of biased engagement with a sealing member as an incident to rotation of the spray tip. These spray nozzle assemblies typically use O-rings or smaller sized annular sealing members. Such O-ring seals are more susceptible to leakage, particularly at low pressure start-up conditions, and may lose strength sufficient to adequately maintain the spray tip in operative or properly aligned position. Typically, a plurality of such O-rings are required to achieve proper sealing and biasing, which results in additional components that must be handled and replaced, and which can be lost or misplaced.

To make the spray nozzle body and quick disconnect tips with the necessary intricate camming and locking surfaces for reliable operation, it has been common to plastic injection mold such components. Plastic spray nozzle assemblies, however, may be unsuitable for long term reliable usage in many industrial and commercial applications. Heretofore it has been difficult to efficiently or economically machine intricate camming and locking elements in metal quick disconnect nozzle bodies and tips.

OBJECTS AND SUMMARY OF THE INVENTION

It is an object of the present invention to provide a quick disconnect spray nozzle assembly having an improved elongated sealing and biasing member that is conveniently mountable externally on the spray tip and which is adapted for long time and reliable usage. A related object is to provide such a quick disconnect spray nozzle assembly in which the elongated sealing and biasing member is designed to ensure precise and proper mounting on the spray tip.

Another object is to provide a quick disconnect nozzle assembly of the above kind in which the sealing and biasing member has a unique compact design and is mountable on the spray tip without excessively increasing the size or axial length of the spray tip.

A further object is to provide a quick disconnect assembly as characterized above in which the spray tip can be turned and cammed into fully assembled and engaged relation with the nozzle body without the necessity for the installer to manually force the spray tip inwardly against the biasing member.

Another object is to provide a spray nozzle assembly of the above kind which prevents an installer from turning the spray tip beyond a predetermined mounted position during assembly and which prevents disorientation of the spray tip during usage. A related object is to provide such a quick disconnect spray nozzle assembly in which the spray tip is quickly and reliably rotatable into exact, predetermined engagement with the nozzle body and is positively locked in such position during usage.

Yet another object is to provide such a spray nozzle assembly which permits the installer to feel when the spray tip is properly assembled.

Still a further object is to provide a spray nozzle assembly of the foregoing type which permits quick and easy mounting of the spray tip in the body as an incident to simple rotational movement of the tip, but as a reliability and safety feature, requires that the user consciously force the spray tip against the sealing and biasing member to permit disassembly and removal.

Another object is to provide a spray nozzle assembly of the foregoing type in which the spray tip and body are made of metal and have cooperating camming and locking elements designed for efficient machining manufacture.

Other objects and advantages of the invention will become apparent upon reading the following detailed description and upon reference to the drawings, in which:

Figure 1:
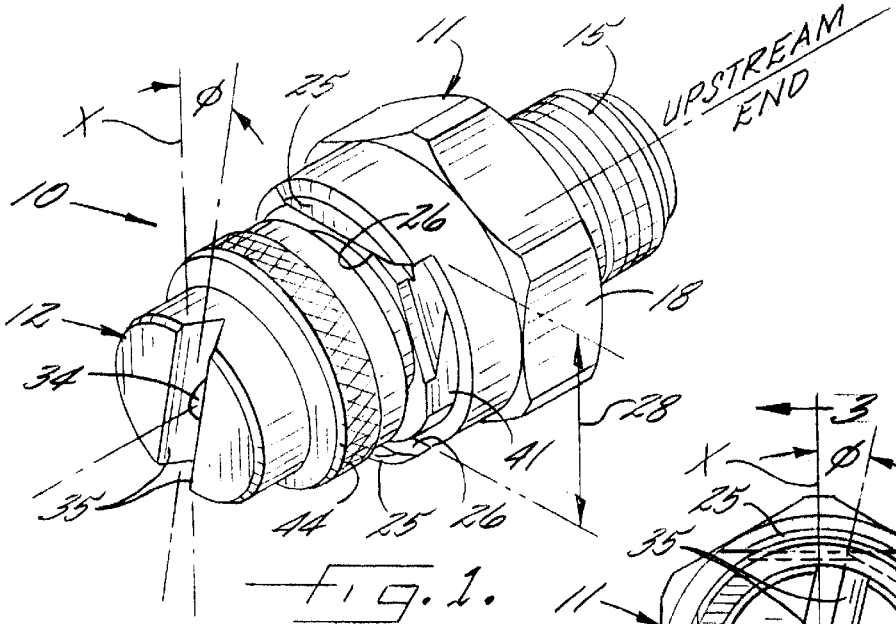
FIG. 1 is a perspective of an illustrative spray nozzle assembly embodying the present invention.
Figure 2:
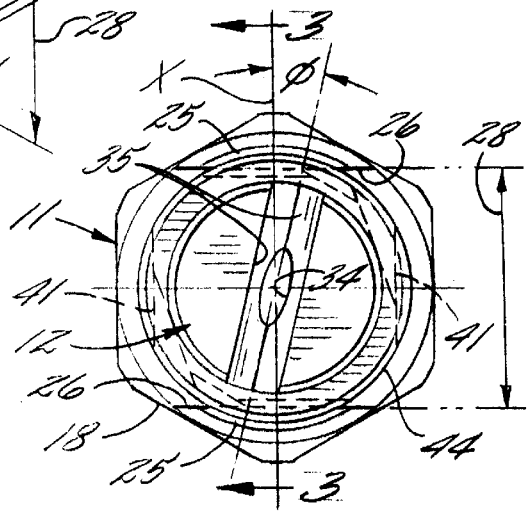
FIG. 2 is a plan view of the downstream end of the nozzle assembly shown in FIG. 2.
Figure 3:
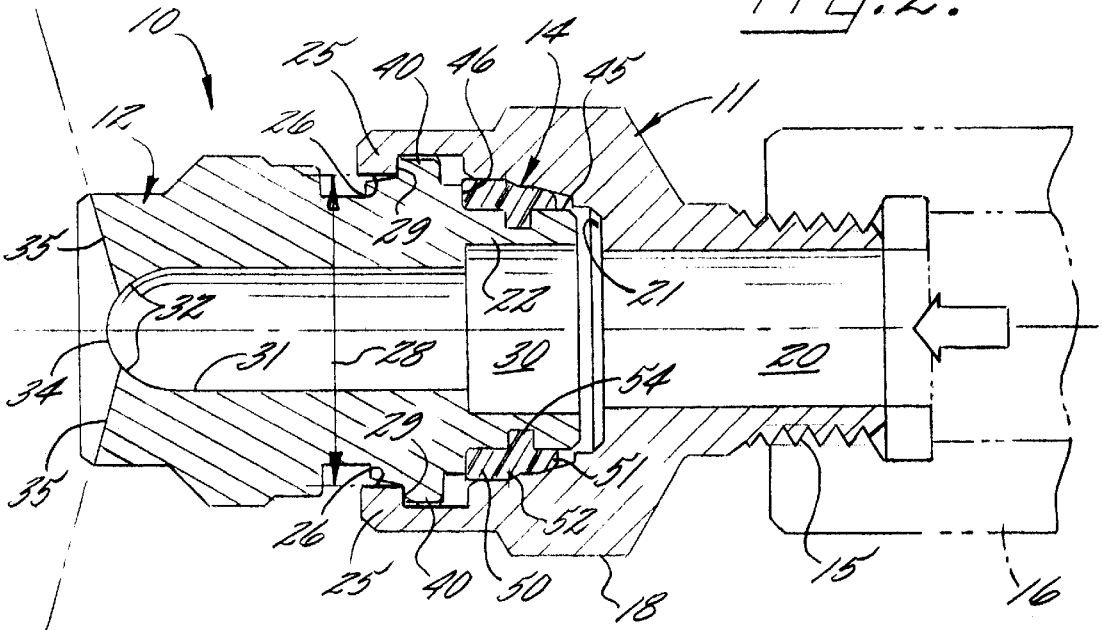
FIG. 3 is an enlarged longitudinal section of the illustrative spray nozzle assembly, taken in the plane of line 3—3 in FIG. 2.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to the drawings, there is shown an illustrative quick disconnect spray nozzle assembly 10 embodying the present invention. The nozzle assembly 10 basically includes a nozzle body 11, a spray nozzle tip 12, and a combination seal and pressure exerting member 14. The nozzle body 11 and tip 12 both preferably are made of metal, such as stainless steel or brass. The nozzle body 11 in this instance has an upstream end portion formed with external threads 15 for connecting the nozzle body 11 to a suitable fluid supply conduit or header 16 and a hexagonal portion 18 which enables a wrench to be applied to the body 11 to tighten the connection as required. The nozzle body 11 has a fluid passageway defined by an upstream internal bore 20 and an enlarged downstream chamber 21 designed for receiving an upstream end portion 22 of the spray tip 12 and the seal and pressure exerting member 14.

The downstream end of the body 11 is formed with a pair of diametrically opposed spray tip retaining flanges 25 which in this case have straight inner sides 26 that define a cross slot access opening 28 to the chamber 21. The upstream sides 29 of the diametrically opposed flanges 25 define retaining ledges for the assembled spray tip 12, as will become apparent.

The upstream end portion 22 of the spray tip 12 is formed with an internal fluid passageway bore 30 sized similarly to the internal fluid passageway bore 20 of the body 11. The spray tip 12 further includes a forward portion that defines a slightly reduced diameter bore 31 that communicates with the bore 30 and terminates in a forward curve or conical end 32 formed with a spray orifice 34. The spray orifice 34 in this instance is defined by a transversely directed "V"-shaped cut in the forward end portion of the spray tip so as to define a generally elongated outlet with diverging sides 35 for producing a flat spray pattern.

Figure 4:
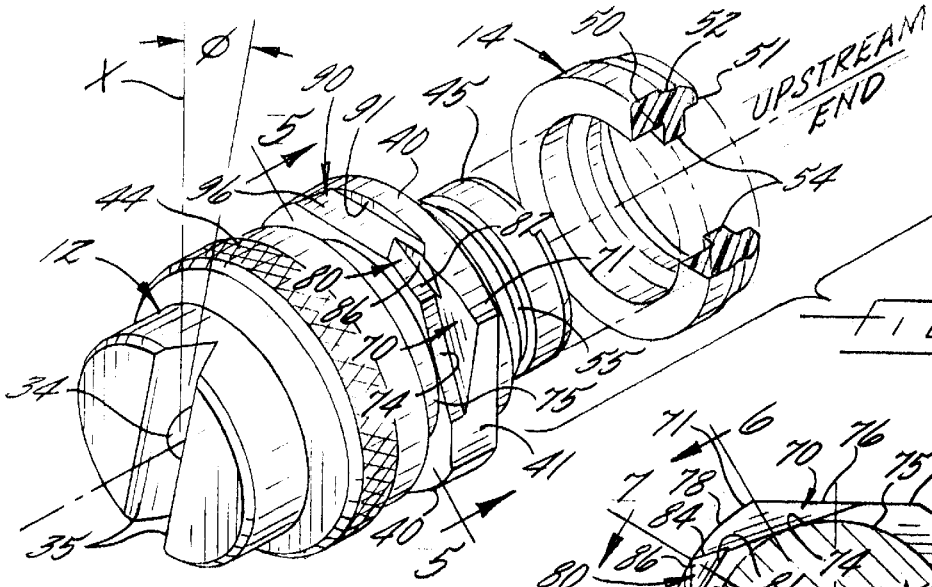
FIG. 4 is an exploded perspective of the spray tip and seal and biasing member of the illustrative spray nozzle assembly.
Figure 5:
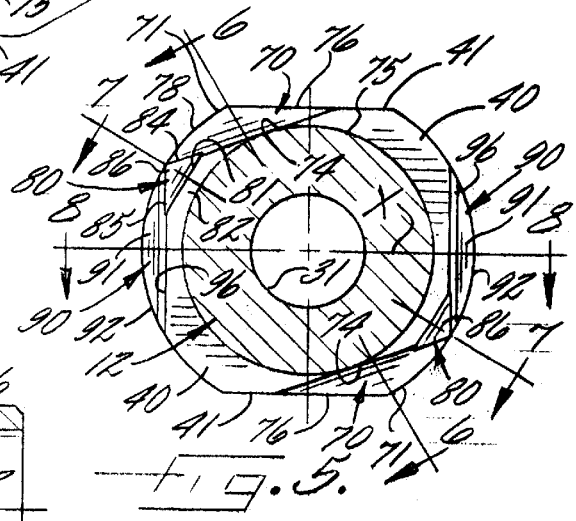
FIG. 5 is a transverse section of the spray tip, taken in the plane of line 5—5 in FIG. 4.

The spray tip 12 further includes a pair of diametrically opposed camming and locking lugs 40, which in this case are formed from an integral annular flange of the spray tip machined with flats 41 on opposite lateral sides thereof. The flats 41 as seen in FIGS. 4 and 5 have a laterally spacing slightly less than the spacing between the inner sides 26 of the retaining flanges 25 of the nozzle body 11 for enabling the upstream end portion 22 of the spray tip 11, including the retaining flanges 40, to be inserted into the cross slot opening 28 of the nozzle body 11 and rotated into assembled position. To facilitate gripping and turning of the spray tip 12 during assembly and disassembly, the spray tip 12 has an outer circular cylindrical section 44 which is located downstream of the locking lugs 40 and is knurled for easy gripping.

In accordance with an important aspect of the invention, the seal and pressure exerting member is externally mounted on the spray tip and has a compact tubular design for enhanced, multidirectional sealing and long term reliable spray tip biasing. The seal and pressure exerting member 14 in this case is mounted on a reduced diameter upstream end or extension 22 of the spray tip which defines a cylindrical mounting surface 45 and an downstream radial seat 46 defined by an integral, enlarged diameter shoulder of the spray tip 12. The seal and pressure exerting member 14 has an asymmetrical tubular design which includes an enlarged cylindrical downstream end 50, a rounded or radiused upstream end 51 of lesser radial width than the downstream end 50, and an intermediate reversely radiused section 52 interconnecting the downstream and upstream ends 50, 51.

Figure 12:
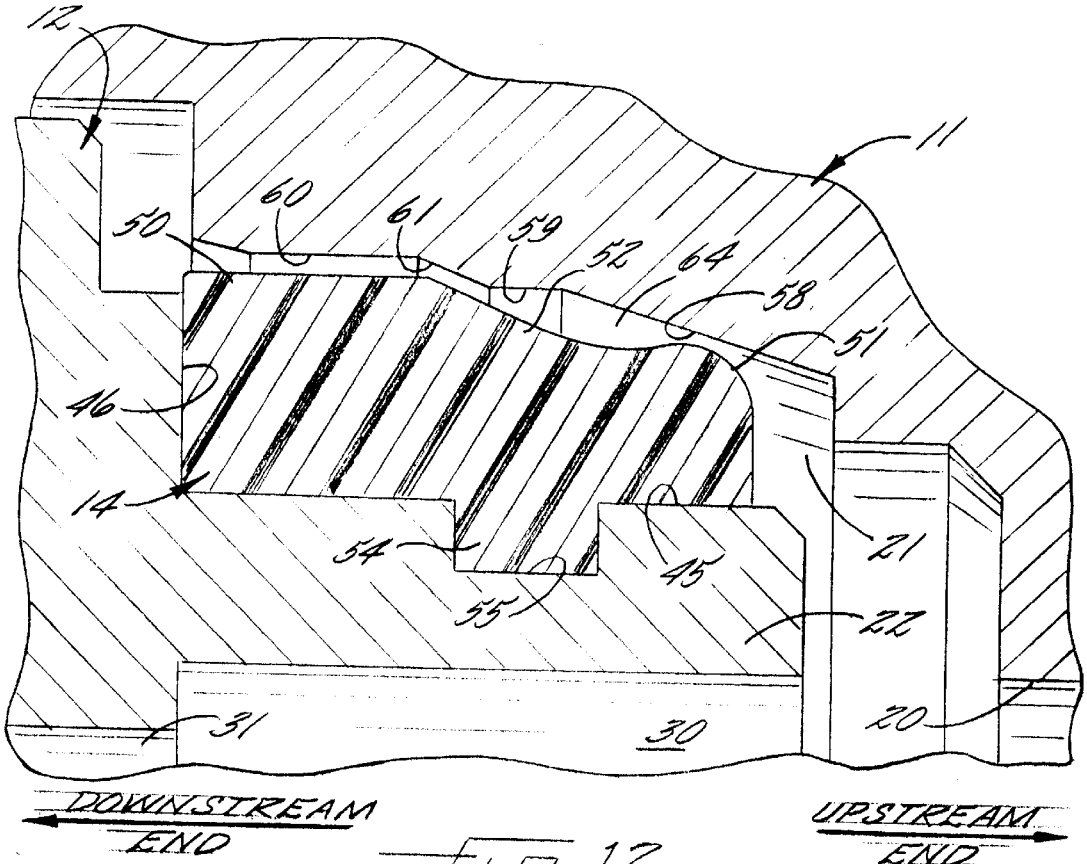
FIG. 12 is an enlarged fragmentary section showing the spray tip being positioned in the nozzle body, prior to rotation in a mounting direction.
Figure 13:
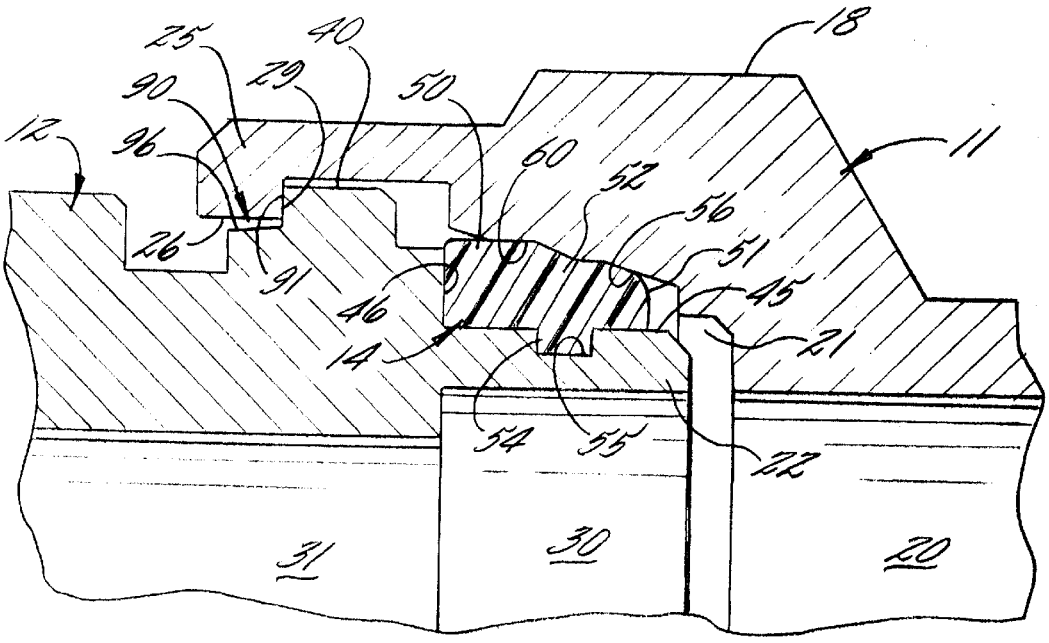
FIG. 13 is an enlarged fragmentary section, showing the spray tip after being rotated into mounted position in the nozzle body.

For positively securing and retaining the seal and pressure exerting member 14 in mounted position on the spray tip 12, the seal and pressure exerting member 14 is formed with an inwardly extending annular rib 54 that is positionable in an annular groove 55 formed in the cylindrical mounting surface 45, as shown in FIGS. 12 and 13. The rib 54 and groove 55 in this case have substantially rectangular cross-sectional configurations which positively locate and retain the pressure exerting and sealing member 14 in mounted position. For ensuring that the seal is mounted in proper axial orientation on the spray tip, i.e., with the enlarged end 50 downstream and the rounded smaller end 51 upstream, the groove 55 is formed in logitudinally off centered in the mounting surface 45. Hence, with the sealing and biasing member 14 properly mounted on the spray tip 12, it can be seen that the enlarged downstream end 50 squarely abuts the spray tip seat 46 with an outer radial portion extending a small distance outwardly of the seat 46.

In keeping with the invention, the spray tip receiving chamber 21 of the nozzle body 11 is specifically designed for enhanced sealing engagement with the sealing and biasing member 14 as an incident to the spray tip 12 being axially forced into the nozzle body 11 during assembly. To this end, the nozzle body chamber 21 is formed with a seal seating cavity defined by an upstream, frustoconical wall section 58 tapered at a small angle, such as 16 degrees, to the longitudinal axis, an intermediate cylindrical wall section 59, and a downstream enlarged diameter cylindrical wall section 60 communicating with the intermediate cylindrical wall section 59 through a conical or tapered wall section 61.

It can been seen that when the spray tip 12 with the pre-mounted seal and biasing member 14 is initially inserted into the nozzle body chamber 21, the rounded upstream end 51 of the seal and biasing member 14 will engage the tapered wall section 58 of the nozzle body 11, the cylindrical section 60 of the nozzle body 11 will encompass and receive the cylindrical downstream end 50 of the seal and pressure exerting member 14, and the radiused intermediate section 52 of the seal bearing member 14 and the juncture of the upstream and intermediate wall sections 58,59 define a small gap 64 therebetween. Continued forceful direction of the spray tip 12 into the body 11, as will become apparent, will cause axial contraction of the seal and pressure exerting member 14 with resulting axial and radial sealing forces acting about the entire curvature of the upstream sealing member end 51 and the upstream tapered seating section 58 of the nozzle body 11, with axial sealing forces acting between the radial spray tip seat 46 and the downstream sealing member end 50, and with radial sealing forces ultimately acting between the outer perimeter of the enlarged downstream sealing member end 50 and the cylindrical section 60 of the nozzle body 11 as a result of radial expansion of the seal and pressure exerting member 14 incident to its axial compression. At the same time, the small gap 64 between the intermediate sections of the seal member 14 and nozzle body 11 allows the intermediate section 52 of the seal and biasing member 14 to radially expand during spring-like axial contraction to further enhance axial biasing. The resulting multidirectional sealing forces have been found to effect reliable sealing between the spray tip 12 and nozzle body 11 even during start up or low pressure spraying. Indeed, the rounded upstream seal member end 51 functions much like an O-ring, while the enlarged downstream seal member end 50, combined with the relatively short length configuration of the seal and biasing member 14, provides the seal and biasing member 14 with stability for long time reliable usage. The seal member configuration not only provides reliable sealing between the spray tip and nozzle body, but also provides effecting axial biasing for maintaining the spray tip in operative engagement with the nozzle body, without the need for auxiliary O-rings and springs.

With the seal and biasing member 14 externally mounted and positively retained on the spray tip 12 as illustrated, it will be appreciated that the installer can easily see that the seal and biasing member 14 is properly positioned during spray tip assembly. Furthermore, upon disassembly and removal of the spray tip 12, the nozzle body 11 can be flushed and cleaned without the difficulty or chance of dislodging and losing the seal. Yet, external mounting of the sealing and biasing member 14 does not significantly increase the size or mass of the spray tip. Indeed, the illustrated sealing and biasing member 14 is relatively compact in design, having an axial length less than the radius of the mounting surface 45 upon which it is seated on the spray tip 12 and the rounded upstream end 51 being no larger in size than a conventional O-ring seal.

Figure 6:
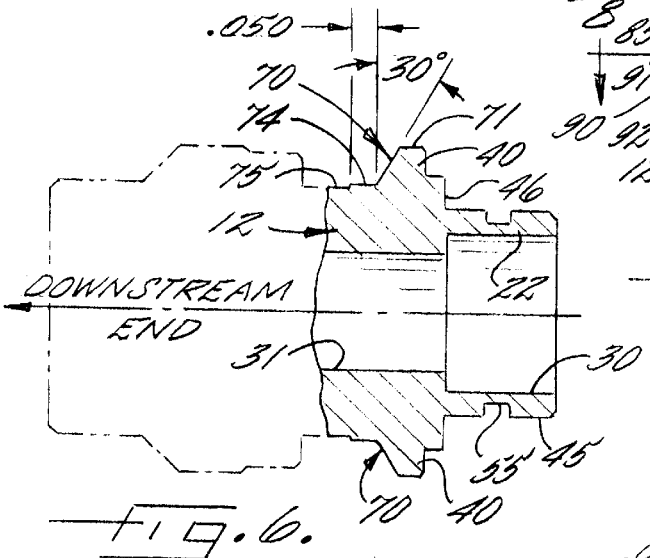
FIGS. 6, 7 and 8 are fragmentary sections of the spray tip of the illustrative spray nozzle assembly, taken in the planes of lines 6—6, 7—7, and 8—8, respectively, in FIG. 5.
Figure 7:
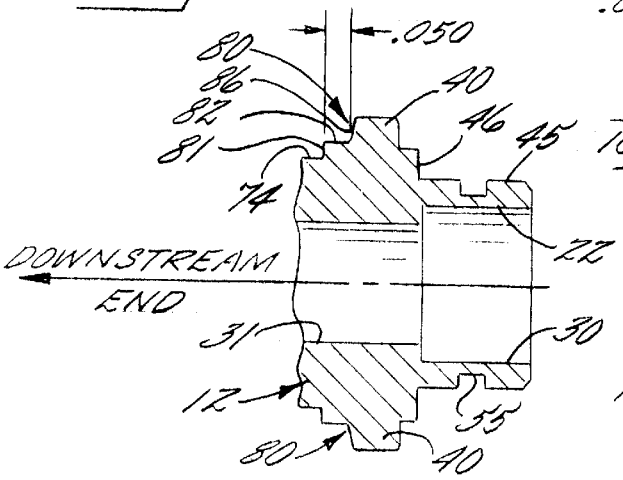

In accordance with a further important feature of the invention, the spray tip locking and camming lugs 40 have easy to manufacture planar camming and locking surfaces designed to enable quick turn installation and locking of the spray tip 12 in precise assembled position in the body 11, without the installer exerting axial pressure on the spray tip. To this end, the lugs 40 of the spray tip 12 are formed with a pair of diametrically opposed planar camming surfaces 70 which extend partially through respective curved ends 71 of the lugs 40 and partially through the flats 41. The illustrated camming surfaces 70 extend outwardly, in an upstream direction, at an acute angle, such as 30 degrees, to the spray tip axis. As illustrated in FIGS. 4–6, each camming surface 70 is angularly oriented so as to cut through both a portion of a respective flat 41 of the spray tip locking lug 40 and a portion of the curved end 71. In the illustrated embodiment, the camming surfaces 70 are oriented such that a radial line in the plane of the camming surface is disposed at an angle of 30 degrees to an X axis of the spray tip 12 extending normal to the flats 41, with each camming surface 70 extending over an angular arc of about 60 degrees (FIG. 9A).

The illustrated camming surfaces 70 each have a generally triangular shape, with a first or inner side 74 defined by a straight line of intersection between the camming surface 70 and a planar side wall 75 parallel to the axis of the spray tip 12, a second side 76 defined by a straight line of intersection between the camming surface 70 and the flat 41, and third side 78 defined by a slightly arced line of intersection between the camming surface 70 and the curved end 71 of the lug 40. The inner side wall 74 of the camming surface 70 in this cases has a relatively small depth or axial length, such as about 0.050 inches, extending to the downstream side of the integral flange from which the locking lugs 40 are formed.

Figure 9A:
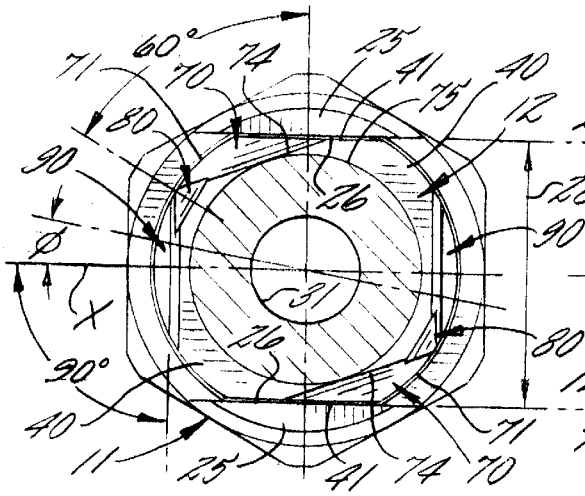
FIG. 9A is a transverse section of the illustrated spray nozzle assembly, showing the spray tip inserted into the nozzle body, prior to rotation in a mounting direction.
Figure 9B:
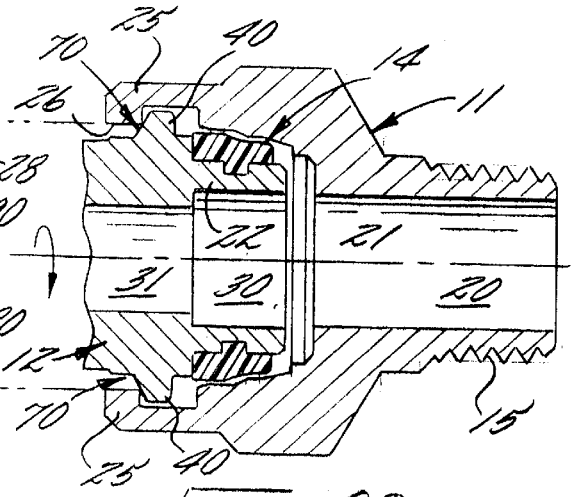
FIG. 9B is a fragmentary longitudinal section of the spray nozzle assembly shown in FIG. 9A.

It will be seen that when the upstream end portion 22 of the spray tip 12 and the locking lugs 40 are inserted into the nozzle body cross slot 28 and rotated in a clockwise direction, as viewed in FIGS. 9A and 9B, portions of the triangular camming surfaces 70 adjacent their outer generally pointed ends will first come into contact with the retaining flanges 25 of the nozzle body 11. Continued rotation of the spray tip 12 in a clockwise direction, through an angular arc of about 60 degrees, will cause the camming surfaces 70 to draw the spray tip 12 into the nozzle body 11 along a helical path of contact across the camming surfaces 70, axially compressing the biasing sealing member 14 between the spray tip 12 and nozzle body 11 as the spray tip moves into the body 11. No axial force need be exerted on the spray tip 12 by the installer.

Figure 10A:
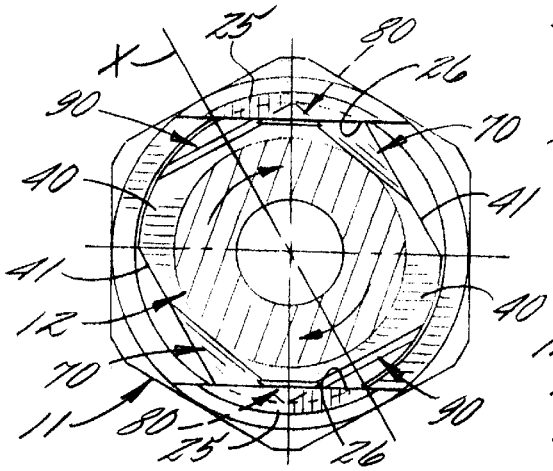
FIGS. 10A and 10B are sections similar to FIGS. 9A and 9B, but showing the spray tip rotated 60 degrees in a mounting direction so as to engage detent surfaces of the spray tip with the nozzle body.
Figure 10B:
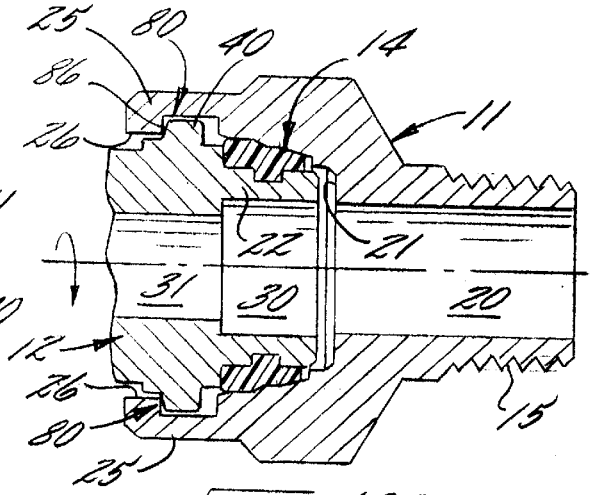

In keeping with the invention, the spray tip locking lugs are formed with further planar surfaces, oriented in angular offset relation to the camming surfaces, for defining integral detents and locking ledges on the spray tip. In the illustrated embodiment, a detent is formed adjacent each end of the camming surface 70 by a relatively small planar detent surface 80 lying in a radial plane (i.e. a plane perpendicular to the axis of the spray tip) at a common axial location as the first or inner side 74 of the camming surface 70. Each detent surface 80 again has a triangular configuration, with a first or inner side 81 defined by a straight line of intersection below the detent surface 80 and a planar side wall 82 of the detent surface extending parallel to the axis of the spray tip in angular relation to the camming surface side wall 75, a second straight side 84 defined by a straight line of intersection between the detent surface 80 and the camming surface 70, and a third side 85 defined by the straight line of intersection between the detent surface 80 and a locking surface side wall 86 located in angular relation to the detent side wall 82 and extending to a deeper depth. With the first or inner sides 74, 81 of the camming surface 70 and detent surface 80 being at a common axial location on the spray tip, the side walls 74, 82 have a common axial depth, such as 0.050 inches. It will be seen that with the detent surfaces 80 being, angularly adjacent the camming surfaces 70, with a radial line in the plane of each detent surface angled 60 degrees to the axis of the spray tip, 60 degree rotary movement of the spray tip 12 relative to the body during installation will cause the detent surfaces 80 to be moved into engagement with the nozzle body retaining flanges 25 (FIGS. 10A and 10B), establishing the furthest point of inward movement of the spray tip 12 into the body 11 against the sealing and biasing member 14.

For enabling snap action engagement of the spray tip 12 into precise and positively retained mounted position in the nozzle body 11, the spray tip 12 is formed with a planar locking surfaces 90 in axially offset relation from the detent surfaces 80. Each locking surface 90 in this case has one side 91 defined by a straight line of intersection between the locking surface 90 and the locking surface side wall 96, and a second curved side 92 defined by a curved line of intersection between the locking surface 90 and the curved locking lug end 71. The locking surface 90 in this instance is oriented in 90 degree offset relation to the spray tip flats 41, i.e. with a radial line in the plane of each locking surface 90 being oriented in 90 degree relation to the X axis normal to the spray tip flats 41.

Figure 8:
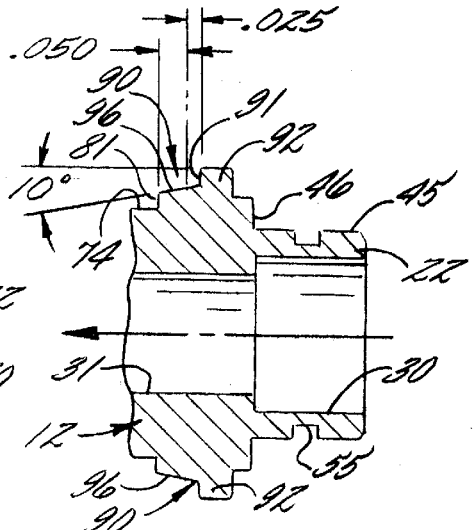
Figure 11A:
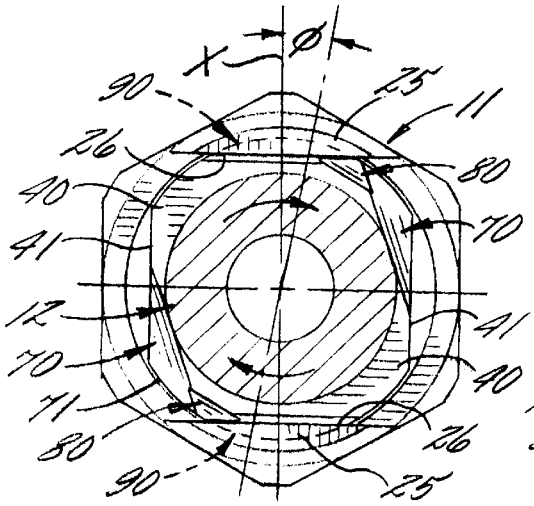
FIGS. 11A and 11B are sections similar to FIGS. 10A and 10B, but showing the spray tip rotated 90 degrees into a fully mounted and locked position in the nozzle body.
Figure 11B:
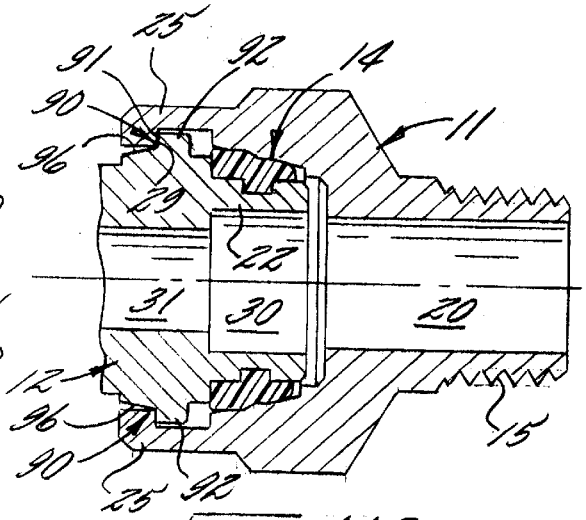

To effect the positive detent and locking action, the locking surface 90 need only be axially offset a relatively small distance with respect to the detent surface 80 such as 0.025 inches. As an incident to the spray tip 12 being rotated 90 degrees in the nozzle body 11 during assembly, the detent surfaces 80 will pass completely over the nozzle body retaining flanges 25 so as to allow the spray tip locking surfaces 90 to drop, under the biasing force of the seal and biasing member 14, into engagement with the nozzle body retaining flanges 25 with a distinct snap locking action as shown in FIGS. 11A and 11B. To accommodate possible tolerance variations in the manufacture of the spray tip 12 and nozzle body 11, the locking surface side walls 96 in this case are angled inwardly in a downstream direction a relatively small amount to the spray tip axis, such as 10 degrees (FIG. 8). Hence, the locking surface side walls 96 will enter the cross slot opening 28 in the nozzle body 11, without interference, for reliable snap action engagement.

Not only does such snap action engagement with the nozzle body enable the installer to feel when the spray tip 12 moves into properly assembled engagement with the nozzle body 11, the spray tip 12 is positively retained in such condition during usage and the orientation of the spray tip 12 cannot inadvertently become altered. In this regard, upon being rotated into its mounted position, the locking surface walls 91 will engage the nozzle body retaining flanges 25 to prevent further rotation in the mounting direction. With the locking surfaces 90 being disposed below the level of the detent surfaces 80, the detent will prevent reverse rotational movement of the spray tip 12 in the body 11. Thus, the spray tip 12 is positively retained in mounted position. Since the spray tip camming, detent, and locking surfaces 70, 80, 90 all are planar, as well as the side wall surfaces 75, 82, 96, one skilled in the art will appreciate that such surfaces are adapted for efficient machining or other manufacture. Moreover, a person skilled in the art will understand that the elongated discharge orifice 34 may be oriented a predetermined acute angle $\phi$, such as 10 degrees, with respect to the spray tip X axis and hence, the spray tip flats 41, for effecting a slight angular offset of the discharging spray pattern with respect to the longitudinal axis of a common header or liquid supply boom upon which a plurality of such spray nozzles are mounted.

While the spray tip 12 permits quick turn assembly as an incident to simple rotational movement, as a reliability and safety feature, to effect rotation or removal of the spray tip from the nozzle body following assembly, a user must conscientiously force the spray tip inwardly in the nozzle body against the biasing force of the seal and biasing member 14 in order to move the detent surfaces 80 axially beyond the nozzle body locking surfaces 90, for enabling reverse rotation of the spray tip 12 to its removal position with the spray tip flats 41 aligned with the nozzle body cross slot 28. Such feature ensures that the orientation of the spray tip 12 in the nozzle body will not unintentionally be altered.

From the foregoing, it can be seen that the quick disconnect spray nozzle assembly of the present invention has a uniquely designed elongated seal and biasing member externally mounted on the spray tip which is adapted for long time and reliable usage. The spray tip further has diametrically opposed locking lugs formed with planar camming, detent, locking surfaces designed for enabling quick turn installation of the spray tip in the nozzle body without the necessity for the installer to manually force the spray tip inwardly against the biasing member. The spray tip detent and locking surfaces further are designed to positively retain the spray tip in precise assembled engagement with the nozzle body during usage.

What is claimed is:

1. A quick disconnect spray nozzle assembly comprising a nozzle body for connection to a fluid supply source, a removable and replaceable spray tip, said spray tip and nozzle body each having an internal bore for the passage of liquid therethrough, said spray tip having a discharge orifice at a downstream end thereof for imparting a predetermined spray pattern to liquid passing through said liquid passage bores and discharging from said spray tip, said spray having an upstream end portion, an elongated tubular seal and biasing member externally mounted on said spray tip end portion, said nozzle body having a downstream spray tip receiving chamber formed with a seal seating cavity, said spray tip upstream end portion with said elongated seal and biasing member mounted thereon being positionable into said nozzle body receiving chamber and rotatable into mounted position in said nozzle body, said spray tip and nozzle body having cooperating camming and locking surfaces for causing said spray tip and nozzle body to be axially drawn together in response to rotational movement of said spray tip relative to said body and for compressing said seal and biasing member between said spray tip and said nozzle body seating cavity to effect both axial and radial sealing forces between said seal and biasing member and said spray tip and nozzle body seating section and for maintaining a biasing force on said spray tip while in said mounted position.

2. The quick disconnect spray nozzle assembly of claim 1 in which said elongated, tubular seal and biasing member has an asymmetrical design including an enlarged downstream end for engagement with an adjacent seating section of the spray tip and a smaller sized upstream end for engagement with the nozzle body seating cavity.

3. The quick disconnect spray nozzle assembly of claim 2 in which said downstream end of said seal and biasing member is cylindrical in shape and said relatively smaller sized upstream end is rounded.

4. The quick disconnect nozzle assembly of claim 2 in which said spray tip upstream end portion defines a cylindrical mounting surface upon which said seal and biasing member is mounted, and said seal and biasing member has an axial length less than the radius of said cylindrical mounting surface.

5. The quick disconnect spray nozzle assembly of claim 3 in which said seal and biasing exerting member has an inwardly radiused intermediate section between said upstream and downstream ends.

6. The quick disconnect spray nozzle assembly of claim 3 in which said seal and biasing member is mounted on a cylindrical mounting surface of said spray tip upstream end portion, and said downstream end of said seal and biasing member has a greater radial width than the rounded upstream end.

7. The quick disconnect spray nozzle assembly of claim 6 in which said seal and biasing member has an inwardly extending annular rib, and said spray tip seal member mounting surface having an annular groove effective for receiving the seal and biasing member annular rib for retaining the seal and biasing member in mounted position on the spray tip.

8. The quick disconnect spray nozzle assembly of claim 7 in which said seal and biasing member annular rib is disposed in longitudinally off centered relation along the length of said seal and biasing member such that the seal and biasing member can only be mounted on said mounting surface with said annular rib in said rib receiving groove when said enlarged end of said seal and biasing member is properly located adjacent said spray tip seating section.

9. The quick disconnect spray nozzle assembly of claim 8 in which said spray tip seating section includes an outwardly extending radial eat at a downstream end of said cylindrical mounting surface, and said enlarged end of said seal and biasing member being mounted axially adjacent said spray tip radial seat when said seal and biasing member is mounted on said mounting surface with said annular rib in said rib receiving groove.

10. The quick disconnect spray nozzle assembly of claim 3 in which said nozzle body seal seating cavity includes a frustoconical upstream wall section, a cylindrical downstream wall section, and at least one intermediate wall section connecting said upstream frustoconical and downstream cylindrical wall sections, and as an incident to said spray tip and nozzle body being drawn together in response to rotational movement of said spray tip relative to said nozzle body said rounded upstream end of said seal and biasing member is urged into sealing contact with said upstream frustoconical wall section of said nozzle body seating cavity to effect both axial and radial sealing forces therebetween.

11. The quick disconnect spray nozzle assembly of claim 10 in which said spray tip seating section includes a radial seat, and as an incident to said spray tip and nozzle body being drawn together in response to rotational movement of said spray tip relative to said nozzle body said downstream cylindrical end of said seal and biasing member is urged in axial sealing engagement with said spray tip radial seat to effect axial sealing forces therebetween and a cylindrical outer surface of the downstream seal and biasing member is urged into radial engagement with the cylindrical downstream wall section of said nozzle body seat cavity to effect radial sealing forces therebetween.

12. The quick disconnect spray nozzle assembly of claim 11 in which upon positioning of said spray tip upstream end portion and externally mounted seal and biasing member into said nozzle body receiving chamber, said seal and biasing member intermediate section and said nozzle body seating cavity intermediate wall section defining a gap therebetween, and as an incident to said spray tip and nozzle body being drawn axially together in response to rotational movement of said spray tip relative to said nozzle body said seal and biasing member intermediate section is radially expanded into said gap to facilitate axial contraction and enhance axial biasing of said spray tip when in said mounted position.

13. A quick disconnect spray nozzle assembly comprising a nozzle body for connection to a fluid supply source, a removable and replaceable spray tip, said spray tip and nozzle body each having an internal bore for the passage of liquid therethrough, said spray tip having a discharge orifice at a downstream end thereof for imparting a predetermined spray pattern to liquid passing through said liquid passage bores and discharging from said spray tip, said spray tip having an upstream end portion, said spray tip upstream end portion being insertable into said nozzle body and rotatable into mounted position with said body, said spray tip upstream end portion having radial locking elements for securing said spray tip in predetermined angularly orientated mounted position in said nozzle body, a seal and biasing member interposed between said nozzle body and said spray tip upstream end portion, said locking elements each being formed with a planar camming surface engageable with said nozzle body for causing said spray tip and nozzle body to be axially drawn together in response to rotation of said spray tip relative to said nozzle body for compressing said seal and biasing member therebetween to effect sealing forces between said seal and biasing member and the spray tip and nozzle body and to create a biasing force on said spray tip while in said mounted position, said locking elements each being formed with a planar locking surface angularly offset with respect to a planar camming surface, said locking surface of each locking element being engageable with said nozzle body under the biasing force of said seal and biasing member when said spray tip is rotated to said predetermined angular position with respect to said nozzle body for retaining said spray tip in said mounted position, said locking elements each being formed with a planar detent surface disposed between the planar camming and locking surfaces, said detent surfaces each being at an axial location adjacent a downstream axial end of said camming surface, and said locking surface each being axially offset in an upstream direction with respect to said detent surface.

14. The quick disconnect spray nozzle assembly of claim 13 in which said locking lug camming surfaces are engageable with said nozzle body upon insertion of the spray tip upstream end portion into said body for axially drawing said spray tip and nozzle body into mounted position in response to relative rotational movement without the necessity for manually to forcing the spray tip against the seal and biasing member.

15. The quick disconnect spray nozzle assembly of claim 14 in which said nozzle body is formed with locking surfaces, and said spray tip locking elements each being formed with a planar locking surface in angular is offset relation to the camming surface for positively engaging said nozzle body locking surfaces when said nozzle is rotated into said predetermined mounted position, and prior to said spray tip being rotatable in a reverse rotary direction for disassembling said spray tip from said nozzle body said spray tip must be manually forced against the biasing force of said seal and biasing member to disengage said spray tip and nozzle body locking surfaces.

16. The quick disconnect spray nozzle assembly of claim 13 in which said detent surface has a triangular configuration with three sides defined by an inner side located in angular offset relation to the inner side of said camming surface at substantially a common axial location on said spray tip, a second side defined by a line of intersection between the planar detent surface and said planar camming surface, and a third side defined by a line of intersection between said detent surface and a locking side surface intersecting said locking surface.

17. The quick disconnect spray nozzle assembly of claim 16 in which said locking side surface is a planar surface extending in a downstream direction at an angle to said locking surface.

18. The quick disconnect spray nozzle assembly of claim 17 in which the locking side surface extends inwardly in a downstream direction at an angle of about 10 degrees to the longitudinal axis of said spray tip.

19. The quick disconnect spray nozzle assembly of claim 13 in which the lateral sides of said locking elements are laterally spaced flats, and said planar camming surfaces each are angularly offset with respect to said locking element flats such that a radial line in the plane of the camming surface makes an acute angle to an X axis of the spray tip extending normal to the flats.

20. The quick disconnect spray nozzle assembly of claim 19 in which said camming surfaces are angularly offset with respect to said locking element flats such that a radial line in the plane of the camming surface makes an acute angle of about 30 degrees to the X axis of the spray tip extending normal to the locking element sides.

21. The quick disconnect spray nozzle assembly of claim 20 in which said detent surfaces are angularly offset with respect to camming surfaces such that a radial line in the plane of the detent surface makes an acute angle of about 60 degrees to the X axis of the spray tip extending normal to the locking element flats.

22. The quick disconnect spray nozzle assembly of claim 21 in which said locking surfaces are angularly offset at an angle of about 90 degrees to said locking element flats.

23. A quick disconnect spray nozzle assembly comprising a nozzle body for connection to a fluid supply source, a removable and replaceable spray tip, said spray tip and nozzle body each having an internal bore for the passage of liquid therethrough, said spray tip having a discharge orifice at a downstream end thereof for imparting a predetermined spray pattern to liquid passing through said liquid passage bores and discharging from said spray tip, said spray having an upstream end portion, an elongated tubular seal and biasing member externally mounted on said spray tip end portion, said nozzle body having a downstream spray tip receiving chamber formed with a seal seating cavity, said spray tip upstream end portion with said elongated seal and biasing member mounted thereon being positionable into said nozzle body receiving chamber and rotatable into mounted position in said nozzle body, said spray tip upstream end portion having integrally formed radial camming elements, said camming elements each being formed with a planar camming surface engageable with said nozzle body for causing said spray tip and nozzle body to be axially drawn together in response to rotation of said spray tip relative to said nozzle body for compressing said seal and biasing member therebetween to effect sealing forces between said seal and biasing member and the spray tip and nozzle body and to create a biasing force on said spray tip while in said mounted position.

24. The quick disconnect spray nozzle assembly of claim 23 in which said elongated, tubular seal and biasing member has an asymmetrical design including an enlarged downstream end for engagement with an adjacent seating section of the spray tip and a smaller sized upstream end for engagement with the nozzle body seating cavity.

25. The quick disconnect spray nozzle assembly of claim 24 in which said downstream end of said seal and biasing member is cylindrical in shape and said relatively smaller sized upstream end is rounded.

26. The quick disconnect nozzle assembly of claim 25 in which said spray tip upstream end portion defines a cylindrical mounting surface upon which said seal and biasing member is mounted, and said seal and biasing member has an axial length less than the radius of said cylindrical mounting surface.

27. The quick disconnect spray nozzle assembly of claim 26 in which said seal and biasing member has an inwardly extending annular rib, and said spray tip seal member mounting surface having an annular groove effective for receiving the seal and biasing member annular rib for retaining the seal and biasing member in mounted position on the spray tip, and said seal and biasing member annular rib being disposed in longitudinally off centered relation along the length of said seal and biasing member such that the seal and biasing member can only be mounted on said mounting surface with said annular rib in said rib receiving groove when said enlarged end of said seal and biasing member is properly located adjacent said spray tip seating section.

28. The quick disconnect spray nozzle assembly of claim 25 in which said nozzle body seal seating cavity includes a frustoconical upstream wall section, a cylindrical downstream wall section, and at least one intermediate wall section connecting said upstream frustoconical and downstream cylindrical wall sections; and as an incident to said spray tip and nozzle body being drawn together in response to rotational movement of said spray tip relative to said nozzle body, said rounded upstream end of said seal and biasing member is urged into sealing contact with said upstream frustoconical wall section of said nozzle body seating cavity to effect both axial and radial sealing forces therebetween, said downstream cylindrical end of said seal and biasing member is urged in axial sealing engagement with said spray tip seating section to effect axial sealing forces therebetween, and a cylindrical outer surface of the downstream seal and biasing member is urged into radial engagement with the cylindrical downstream wall section of said nozzle body seat cavity to effect radial sealing forces therebetween.

29. The quick disconnect spray nozzle assembly of claim 23 in which said camming element camming surfaces extend outwardly in an upstream direction at an acute angle to a longitudinal axis of the spray tip.

30. The quick disconnect spray nozzle assembly of claim 23 in which said spray tip camming elements are lugs which extend radially outward of said spray tip upstream portion, each said lug having a radial end and laterally spaced sides, and said camming surfaces of each lug extend partially through a radial end of the lug and partially through one lateral side thereof.

31. The quick disconnect spray nozzle assembly of claim 23 in which said camming elements each are formed with a planar locking surface angularly offset with respect to said planar camming surface, said locking surface of each camming element being engageable with said nozzle body under the biasing force of said seal and biasing member when said spray tip is rotated to said predetermined angular position with respect to said nozzle body for retaining said spray tip in said mounted position.

32. The quick disconnect spray nozzle assembly of claim 31 in which said camming elements each is formed with a planar detent surface disposed between the planar camming and locking surfaces, detent surfaces each being at an axial location adjacent a downstream axial end of said camming surface, and said locking surface each being axially offset in an upstream direction with respect to said detent surface.

33. A quick disconnect spray nozzle assembly, comprising a nozzle body for connection to a fluid supply source, a removable and replaceable spray tip, said spray tip and nozzle body each having an internal bore for the passage of liquid therethrough, said spray tip having a discharge orifice at a downstream end thereof for imparting a predetermined spray pattern to liquid passing through said liquid passage bores and discharging from said spray tip, said spray tip having an upstream end portion, said spray tip upstream end portion being insertable into said nozzle body and rotatable into mounted position with said body, said spray tip upstream end portion having radial locking elements for securing said spray tip in predetermined angularly orientated mounted position in said nozzle body, a seal and biasing member interposed between said nozzle body and said spray tip upstream end portion, and said locking elements each being formed with a planar camming surface which extends outwardly in an upstream direction at an acute angle to a longitudinal axis of the spray tip and is engageable with said nozzle body for causing said spray tip and nozzle body to be axially drawn together in response to rotation of said spray tip relative to said nozzle body for compressing said seal and biasing member therebetween to effect sealing forces between said seal and biasing member and the spray tip and nozzle body and to create a biasing force on said spray tip while in said mounted position.

34. The quick disconnect spray nozzle assembly of claim 33 in which said camming surfaces extending at an acute angle of about 60 degrees to the longitudinal axis of said spray tip.

35. The quick disconnect spray nozzle assembly of claim 33 in which said spray tip and nozzle body are made of metal, and said planar camming surfaces are machined.

36. A quick disconnect spray nozzle assembly comprising a nozzle body for connection to a fluid supply source, a removable and replaceable spray tip, said spray tip and nozzle body each having an internal bore for the passage of liquid therethrough, said spray tip having a discharge orifice at a downstream end thereof for imparting a predetermined spray pattern to liquid passing through said liquid passage bores and discharging from said spray tip, said spray tip having an upstream end portion, said spray tip upstream end portion being insertable into said nozzle body and rotatable into mounted position with said body, said spray tip upstream end portion having radial locking lugs for securing said spray tip in predetermined angularly orientated mounted position in said nozzle body, a seal and biasing member interposed between said nozzle body and said spray tip upstream end portion, said locking lugs each having a radial end and laterally spaced sides and being formed with a camming surface that extends partially through the radial end of the lug and partially through one lateral side thereof, and said locking lug camming surfaces being engageable with said nozzle body for causing said spray tip and nozzle body to be axially drawn together in response to rotation of said spray tip relative to said nozzle body for compressing said seal and biasing member therebetween to effect sealing forces between said seal and biasing member and the spray tip and nozzle body and to create a biasing force on said spray tip while in said mounted position.

37. The quick disconnect spray nozzle assembly of claim 36 in which said camming surfaces each have a generally triangular configuration defined by three sides, including an inner downstream side, a second side defined by a lateral side of the lug, and a third side defined by a radial end of the lug.

38. The quick disconnect spray nozzle assembly of claim 37 in which said locking lugs have substantially straight lateral sides and outwardly curved radial ends such that the second side of each camming surface is defined by a straight line of intersection between the planar camming surface and a lateral side of the lug, and the third side of each camming surface is a curved line of intersection between said camming surface and the curved radial end of the lug.

39. The quick disconnect spray nozzle assembly of claim 38 in which said inner side of each camming surface is defined by a straight line of intersection between the camming surface and a planar side surface extending substantially parallel to a longitudinal axis of said spray tip.

40. The quick disconnect spray nozzle assembly of claim 36 in which said nozzle body has an upstream chamber formed with a cross slot for receiving the upstream end portion of said spray tip and said locking lugs, and said cross slot having a lateral spacing greater than the lateral spacing between the lateral sides of the locking lugs.

41. A quick disconnect spray nozzle assembly comprising a nozzle body for connection to a fluid supply source, a removable and replaceable spray tip, said spray tip and nozzle body each having an internal bore for the passage of liquid therethrough, said spray tip having a discharge orifice at a downstream end thereof for imparting a predetermined spray pattern to liquid passing through said liquid passage bores and discharging from said spray tip, said spray tip having an upstream end portion, said spray tip upstream end portion being insertable into said nozzle body and rotatable into mounted position with said body, said spray tip upstream end portion having radial locking elements for securing said spray tip in predetermined angularly orientated mounted position in said nozzle body, a seal and biasing member interposed between said nozzle body and said spray tip upstream end portion, said locking elements each being formed with a planar camming surface engageable with said nozzle body for causing said spray tip and nozzle body to be axially drawn together in response to rotation of said spray tip relative to said nozzle body for compressing said seal and biasing member therebetween to effect sealing forces between said seal and biasing member and the spray tip and nozzle body and to create a biasing force on said spray tip while in said mounted position, said locking elements each being formed with a planar locking surface in a plane substantially perpendicular to a longitudinal axis of said spray tip and angularly offset with respect to said planar camming surface, and said locking surface of each locking element being engageable with said nozzle body under the biasing force of said seal and biasing member when said spray tip is rotated to said predetermined angular position with respect to said nozzle body for retaining said spray tip in said mounted position.

42. A quick disconnect spray nozzle assembly comprising a nozzle body for connection to a fluid supply source, a removable and replaceable spray tip, said spray tip and nozzle body each having an internal bore for the passage of liquid therethrough, said spray tip having a discharge orifice at a downstream end thereof for imparting a predetermined spray pattern to liquid passing through said liquid passage bores and discharging from said spray tip, said spray having an upstream end portion, an elongated tubular seal and biasing member externally mounted on said spray tip end portion, said nozzle body having a downstream spray tip receiving chamber formed with a seal seating cavity, said spray tip upstream end portion with said elongated seal and biasing member externally mounted thereon being insertable into said nozzle body receiving chamber to compress said seal and biasing member between said spray tip and said nozzle body seating cavity for effecting sealing forces between said seal and biasing member and said spray tip and nozzle body seating section as an incident to positioning of said spray tip into mounted position, and said spray tip and nozzle body having cooperating locking elements for locking said spray tip in mounted position in said body as an incident to rotation of said spray tip relative to said body for maintaining a biasing force on said spray tip while in said mounted position.

43. The quick disconnect spray nozzle assembly of claim 42 in which said elongated, tubular seal and biasing member has an asymmetrical design including an enlarged downstream end for engagement with an adjacent seating section of the spray tip and a smaller sized upstream end for engagement with the nozzle body seating cavity.

44. The quick disconnect spray nozzle assembly of claim 43 in which said downstream end of said seal and biasing member is cylindrical in shape and said relatively smaller sized upstream end is rounded.

45. The quick disconnect spray nozzle assembly of claim 44 in which said seal and biasing exerting member has an inwardly radiused intermediate section between said upstream and downstream ends.

46. The quick disconnect spray nozzle assembly of claim 44 in which said seal and biasing member is mounted on a cylindrical mounting surface of said spray tip upstream end portion, and said downstream end of said seal and biasing member has a greater radial width than the rounded upstream end.

47. The quick disconnect nozzle assembly of claim 43 in which said spray tip upstream end portion defines a cylindrical mounting surface upon which said seal and biasing member is mounted, and said seal and biasing member has an axial length less than the radius of said cylindrical mounting surface.

* * * * *